US006659179B2

(12) United States Patent
Nguyen

(10) Patent No.: US 6,659,179 B2
(45) Date of Patent: Dec. 9, 2003

(54) METHOD OF CONTROLLING PROPPANT FLOWBACK IN A WELL

(76) Inventor: Philip D. Nguyen, 1107 Jones St., Duncan, OK (US) 73533

( * ) Notice: Subject to any disclaimer, the term of this patent is extended or adjusted under 35 U.S.C. 154(b) by 148 days.

(21) Appl. No.: 09/860,206

(22) Filed: May 18, 2001

(65) Prior Publication Data

US 2002/0179302 A1 Dec. 5, 2002

(51) Int. Cl.[7] ..... E21B 43/08

(52) U.S. Cl. ..... 166/308; 166/230; 166/227; 166/381

(58) Field of Search ..... 166/230, 227, 166/381, 308

(56) References Cited

U.S. PATENT DOCUMENTS

| | | | | |
|---|---|---|---|---|
| 5,330,005 A | | 7/1994 | Card et al. | 166/280 |
| 5,439,055 A | | 8/1995 | Card et al. | 166/280 |
| 5,492,178 A | | 2/1996 | Nguyen et al. | 166/276 |
| 5,501,275 A | | 3/1996 | Card et al. | 166/280 |
| 5,551,514 A | | 9/1996 | Nelson et al. | 166/280 |
| 5,560,427 A | * | 10/1996 | Jones | 166/280 |
| 5,775,425 A | | 7/1998 | Weaver | 166/276 |
| 5,901,789 A | * | 5/1999 | Donnelly et al. | 166/207 |
| 5,934,376 A | | 8/1999 | Nguyen et al. | 166/278 |
| 6,012,522 A | * | 1/2000 | Donnelly et al. | 166/207 |
| 6,263,966 B1 | * | 7/2001 | Haut et al. | 166/230 |
| 6,412,565 B1 | * | 7/2002 | Castano-Mears | 166/230 |

OTHER PUBLICATIONS

Brochure, "Sand Control Applications," by Halliburton Energy Services, Inc (Undated).

Brochure, "STIMPAC Service Brochure," by Schlumberger Limited (Undated).

M. Economides, L. Watters & S. Dunn–Norman, Petroleum Well Construction on 537–42 (Undated).

Dickinson, W. et al: "A Second–Generation Horizontal Drilling System," Paper 14804 presented in 1986 IADC/SPE Drilling/Conference in Dallas, TX.

Dickinson, W. et al.: "Gravel Packing Of Horizontal Wells," Paper 16931 presented at 1987 SPE Annual Technical Conference and Exhibition held in Dallas, Texas, Sept. 27–39.

M. Economides, L. Watters & S. Dunn–Norman, Petroleum Well Construction Section 18–9.3, at 533–34 (1998).

LaFontaine, L. et al.: "New Concentric Annular Packing System Limits Bridging in Horizontal Gravel Packs," Paper 56778 presented at the 1999 SPE Annual Technical Conference and Exhibition in Houston, Texas, Oct. 3–6.

* cited by examiner

*Primary Examiner*—David Bagnell
*Assistant Examiner*—Robert D Jones
(74) *Attorney, Agent, or Firm*—Robert A. Kent; John F. Booth

(57) ABSTRACT

A method of treating a subterranean hydrocarbon bearing formation penetrated by a perforated section of a cased wellbore. A treating mixture containing particulate material is pumped from the casing through the perforations and into the formation. After injection of the particulate through the perforations a screen is circumferentially expanded in the casing and hydrocarbons are flowed through the perforations and into the casing while the screen prevents particulate materials from flowing into the well.

12 Claims, 2 Drawing Sheets

METHOD OF CONTROLLING PROPPANT FLOWBACK IN A WELL

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

1. Technical Field

The present inventions relate to improvements in the production of hydrocarbons from wells, which intersect fractured subterranean formations. More particularly the present inventions relate to improvements in methods and apparatus for controlling the flowback of particulate materials used in fractured wells during the subsequent production of hydrocarbons from a subterranean formation.

2. Background of the Invention

In the course of treating and preparing subterranean wells for production, frequently particulate materials are used as a proppant in fractures extending outwardly from the wellbore. The term proppant is used herein to refer to the particulate materials used in the hydraulic fracturing process. In fracturing operations, proppant is carried into fractures created when hydraulic pressure is applied to subterranean formations to a point where fractures are developed. Proppant suspended in a fracturing fluid is carried outwardly away from the wellbore within the fractures as the fractures are created and extended with continued pumping. Upon release of pumping pressure, the proppant materials remain in the fractures holding the separated formation faces in an open position forming a channel for flow of formation fluids back to the wellbore.

The proppant is used to keep the propped fractures opened and thus connect the wellbore with the reservoir. However, despite the closure stresses applied on the proppant, high drag forces resulting from high production flow rate can cause proppant to flow out of the fracture and into the wellbore along with the production of oil or gas. Various methods have been attempted to minimize or to stop the flow back of proppant. They include reducing drawdown or production flow rate. Reducing the production flow rate could make operation of the wells uneconomical forcing the operators to abandon the wells.

Coating the proppant at the tail in portion of slurry with resin to transform the proppant pack into consolidate, permeable mass has been used. Various techniques also are described in U.S. Pat. No. 5,492,178, the entire disclosure of which is incorporated herein by reference. Because of the narrow ranges or strict requirements of temperatures and closure stress during curing, most of the treatment with resin coated proppants, especially with the precoated types, can be unreliable resulting in the proppant being produced back immediately or only after a short period after the fracturing treatment.

Other techniques have been used, including releasing treating pressure as soon as the fracturing treatment is completed to allow the fracture to close and the fracturing fluid to flowback, while the proppant is still suspended across the producing portion of the formation. This is known as force-closure technique. The force-closure method often allows a quantity of proppant to be produced back during the operation. However, case histories have indicated that proppant continued to be produced as the wells experience high production flow rates or after they are shut-in and allowed to produce again.

Also, mixing proppant with fibers to create a network between the proppant and the solid strands have been used to minimize proppant movement. U.S. Pat. Nos. 5,330,005, 5,439,055,. 5,551,514 and 5,501,275 disclose methods of incorporation of a fibrous material in the fluid with which the particulates are introduced into the subterranean formation and the entire disclosure of which are incorporated herein by reference. The use of fibers tends to reduce the fracture conductivity, about 30% or more. In some cases, the wells become plugged if a severe loading of fibers is concentrated at one location. In addition, fibers were unsuccessful in controlling proppant flow back for high temperature and high production wells.

Therefore, it is desirable to provide a method and apparatus, which will assist in preventing movement or flowback of proppant into a wellbore without significantly reducing the permeability of the particulate pack and while allowing aggressive production flowback from the well.

SUMMARY OF THE INVENTIONS

The present inventions contemplate an improved method of treating wells and the associated apparatus for controlling and preventing the flowback of particulate into the wellbore during production while increasing the longevity of the well production at an economical level.

In accordance with a preferred embodiment of the invention, an improved method of treating a subterranean formation penetrated by a wellbore is provided comprising the steps of providing a fluid suspension including a mixture of particulate material through the wellbore and depositing the mixture in the formation.

According to one embodiment of the improved method of the present invention, interval(s) of interest in a cased and perforated wellbore are first isolated for example by using packers; completion brine is circulated to clean out the well bore and to make sure the casing perforations are free of debris. Hydraulic fracturing is performed including using a particulate (proppant) that has been gauged against the formation sand to generate propped fractures. The use of coated proppant is optional. The formation fractures are allowed to close by releasing the treating pressure. After the fractures were allowed to closed coiled tubing or the like can be used to circulate proppant from inside the wellbore to the surface. Expandable screens are expanded against the inside of the casing wall (trapping any proppant remaining in the casing against the casing wall) with the expanded screen extending across the perforated intervals to insure all the perforations are covered. The well is then allowed to flow back at maximum flow rate to remove all the fracturing fluid and to ensure that a tight pack of proppant inside all the perforations is formed and to insure the proppant is forced against the outer surface of the screen.

The present inventions, instead of using the screen mesh sizes that stop the formation fines or sand particulates, use screen mesh sizes that are sized to control only the proppant grains. Examples of these expandable screens include screens manufactured from special alloy materials that can withstand erosion caused by high production rate of fines particulate. The packing of proppant inside the perforations and fractures assists in minimizing the impact of fines particulate with the screen. Instead of a straight line, the particles flow in a tortuous path within the proppant pack generating significant drag to reduce its impact against the screen.

The formation fines or sand particulate mostly can be controlled by the sized proppant. However, the smaller particulates can pass through the proppant pack bed. The use of screen mesh as described in this disclosure allows the small particulates to pass through the screen, thus minimizing the buildup or blockage of fines in the pack bed, and allow the proppant, pack to maintain its high conductivity during production.

Surface modifying agent can also be used to coat a thin film on the surface of the proppant during the fracturing treatment to attach the fines particulates and keep them far way from the wellbore and from invading into the proppant pack in the fractures. One example of surface modifying agents includes tackifyer such as described in U.S. Pat. No. 5,775,425, the entire disclosure of which is incorporated herein by reference. Other surface modifying agents such as surfactants and the like could be used.

The use of the expandable screen with well control mesh size to that of proppant provides a reliable method in preventing flow back of proppant into the wellbore, regardless of difficult conditions of the well, such as too high or too low in temperatures, and/or high production flow rate, or the wellbore stability is susceptible to stress cycling during production and shutdown of the well.

The novel features of the inventions are set forth with particularity in the claims. The invention will best be understood from the following description when read in conjunction with the accompanying drawings.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION OF THE INVENTIONS

Figure 1A:
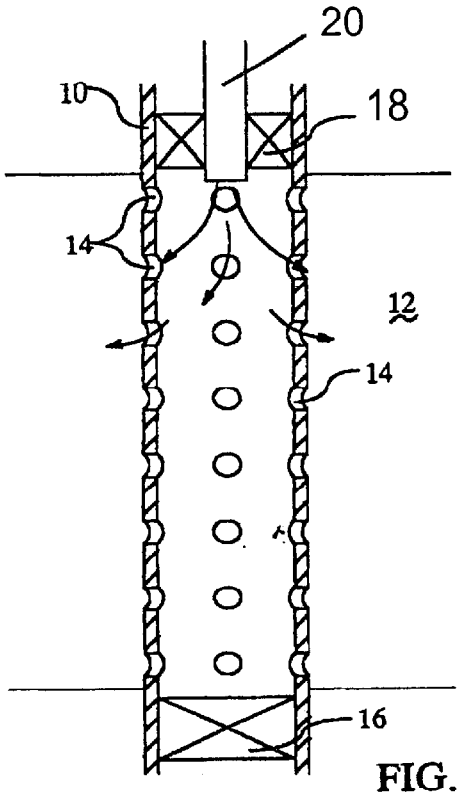
FIGS. 1A–D are longitudinal section views of a wellbore illustrating the steps of one embodiment of the improved process of the present invention.

The present inventions are described by reference to drawings showing one or more examples of how the inventions can be made and used. In these drawings, reference characters are used throughout the several views to indicate like or corresponding parts.

The improved method of the present invention will be described by reference to FIGS. 1–4, which illustrates selected steps in an example formation fracturing process using the proppant flowback control of the present invention. These figures illustrate section views of a portion of a cased well 10 intersecting a subterranean hydrocarbon bearing formation 12. The casing 10 has been previously set and cemented as required. Although the present inventions will be described with regard to a single zone completion configuration, the process and apparatus of the present inventions have application in a variety of downhole well configurations and multiple zone completions. As will be described in detail by reference to these figures, the improved method of the present invention can use one or more of the steps of first isolating the interval(s) of interest in a cased and perforated wellbore using packers. Completion brine is circulated to clean out the well bore as well as to make sure the casing perforations are free of debris. Hydraulic fracturing is performed including using a proppant that has been gauged against the formation sand to generate propped fractures. Resin, polymer, or other coated proppant (either pre coated or coated on the fly) on all or at least 30% of proppant stage can be used if required. The formation fractures are allowed to close by releasing the treating pressure. After the fractures are allowed to close, a coiled tubing or the like may be used to circulate proppant from inside the wellbore to the surface. Expandable screens are positioned in the well (either before or after fracturing) and are expanded against the inside of the casing wall (trapping any proppant remaining in the casing against the casing wall) with the expanded screen extending across the perforated intervals to insure all the perforations are covered. The well is then allowed to flow back at maximum flow rate to removed all the fracturing fluid and to ensure that a tight pack of proppant is forced against the outer surface of the screen.

In FIG. 1A casing 10 has a section containing perforations (passageways) 14 formed through the wall thereof communicating with the formation 12. Perforations can be formed by any conventional means but typically are formed with explosive charges. Various perforation sizes can be designed for perforations. They are either designed for small diameter deep penetration or large diameter shallow penetration. Perforations can be shot with different phasing angles, including 30, 60, 90, 120, 180 or 360 degrees. They are shot either concentrating in a small interval, as in the case of limited entry, or can be a single zone or multi-zones. Each productive zone can be isolated or separated by layers of shale (one on top and one below the zone). The zone can contain only clean sandstone or it can be dirty or highly laminated between sandstone and shale or clay In FIG. 1A a down hole fracturing assembly is illustrated as installed at the formation 12. For description purposes, the assembly is illustrated with a bridge plug 16 and conventional packer 18 set in the perforated casing 10 to isolate the perforated portion of the casing extending into the formation 12. Conduit 20 is representative of a fracturing tool fluid delivery such as a crossover tool or the like. The casing and perforations are cleaned as required prior to hydraulic fracturing. In this embodiment the screen is positioned at the formation after fracturing.

Hydraulic fracturing to produce propped fractures in the formation is conducted in a conventional manner using proppant selected for the particular application. The type and mesh size of proppant used in a fracturing treatment is based on the formation grain size and the closure stress of the formation. The proppant selection is based on balancing size to prevent invasion of formation sand against the proppants ability to allow fluid to flow there through without much restriction or generating high pressure build up. The proppant mesh sizes range from 10 to 70 mesh, but the commonly used proppants are 12/20, 16/30, 20/40, and 40/60 mesh. The proppant must be strong enough to sustain the closure stress of the formation. Crushing of the proppant in the formation often defeats the purpose of propped fractures. In addition to sand, man-made proppants prepared from ceramic, bauxite, glass, organic, inorganic or metallic materials can be used.

Figure 1B:
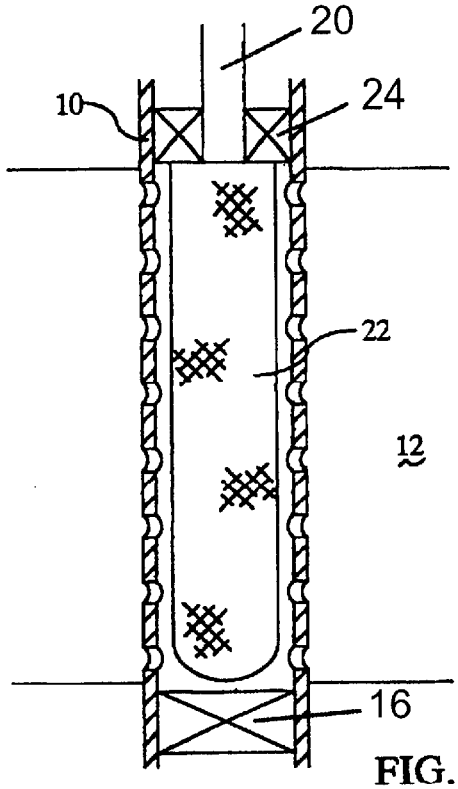

Following fracturing the well pressure is reduced allowing the fractures to close trapping the proppant. Proppant in the casing is cleaned out and a circumferentially expandable screen assembly 22 is positioned in the well casing in the perforated section as shown schematically in FIG. 1B. Screen assembly is schematically shown supported from a packer 24. The expandable screen assembly 22 is shown in the unexpanded state to provide a sufficient annular clearance for installation and annular. It is envisioned that the screen could be installed in the casing 10 prior to the fracturing step with the fracturing fluid flowing through the annulus between the casing and screen assembly. Preferably, the screen 22 is of a sufficient axial length to extend through the entire perforated section of the casing. It is to be understood that the screen assembly 22 could be placed as illustrated in FIG. 1B before the fracturing step. In addition, the fracturing screen assembly of FIGS. 1A and 1B could be run in the well assembled with the perforation equipment.

Figure 1C:
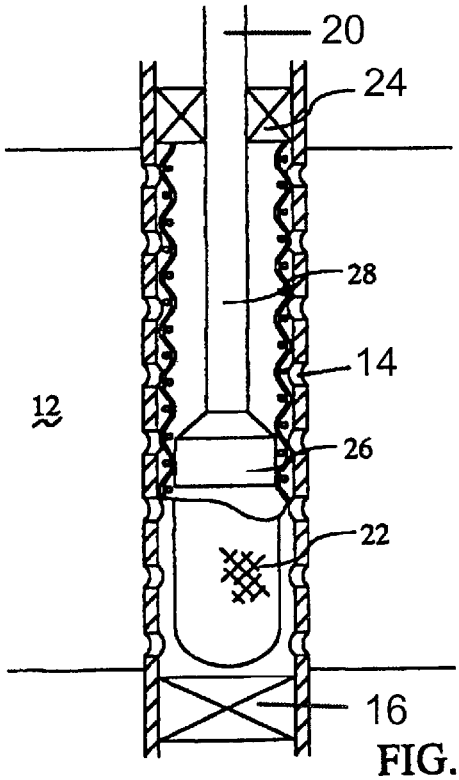
Figure 1D:
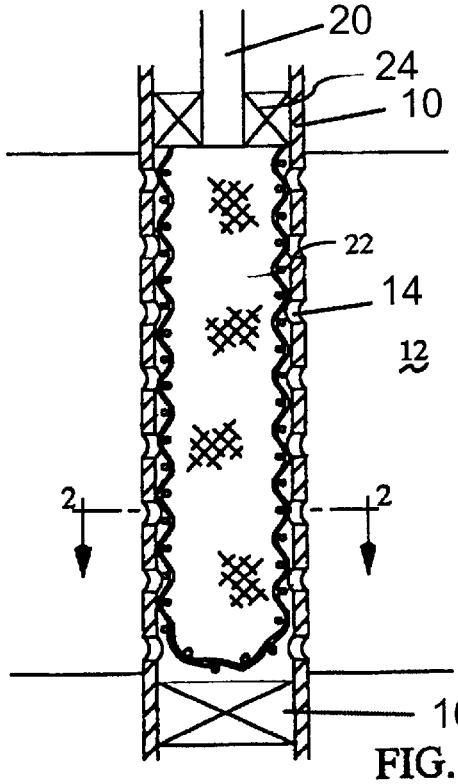

Expandable screen assembly 22 is of the type that can be transported into position in the well in an unexpanded shape and size and thereafter expanded to a larger size and shape. In FIG. 1C screen assembly is illustrated being expanded by a swaging tool 26 and wire line 28. Other conventional methods of expanding the screen assembly 22 could be used such as hydraulic cylinders and the like. According to the present invention the screen 22 is expanded radially along its length to engage the inside wall of the casing 10 as is illustrated in FIG. 1D. In this expanded condition the screen is positioned to cover the perforations. The expanded screen mesh size is selected to capture proppant and prevent its flowback into the wellbore.

Currently as an example, expandable screen systems are available from Weatherford Completion Systems and range from 2⅞" to 5½" in diameter. Expandable screens can for example expand 60% in diameter. Typical inflow areas for expanded expandable screens are 30 to 60% depending on the expanded diameter of the screen. For example a 2⅞" expandable screen can be expanded to diameters between 3½" and 4¼"; a 4" expandable screen can be expanded to diameters between 5⅞" and 6¼"; and a 5½" expandable screen can be expanded to diameters between 8⅜" to 9⅛". An expandable screen can be selected to fit any cased wells with diameters that fall within the expanded diameters.

Commercially available expandable screen systems typically are constructed from three composite layers. A slotted structural base pipe on which overlaps layers of filter media and an outer encapsulating and protective shroud. The expandable screen base pipe can be manufactured from standard pipe slotted along its entire length. The intermediate filter media layer can be formed from stainless steel, Incoloy or corrosion resistant materials. The outer protective shroud ensures the filter media will not be damaged when running the screens into the well and acts as an encapsulating layer that ensures the filter media remain tightly sandwiched together following the completion of screen expansion.

According to the present invention, the screen mesh size is selected to effectively filter out proppant grains without unduly restricting flow. In term of conventional sand control screen, the screen gauges range from 4 to 20. However, for expandable screens the filter media layer has mesh size ranges from 150 to 1,500 microns (i.e. micro-millimeters) are used. The Table below provides examples of screen sizes for various proppant mesh sizes:

| Proppant/Gravel Mesh | Screen Wire Spacing |
|---|---|
| 50–70 | .004" or 0.006" (i.e. 4 or 6 gauge) |
| 40–60 | 0.008" (i.e. 8 gauge) |
| 20–40 | 0.012" (i.e. 12 gauge) |
| 16–30 | 0.016" |
| 10–20 | 0.025" |
| 10–16 | 0.035" |
| 8–12 | 0.05" |

Figure 3:
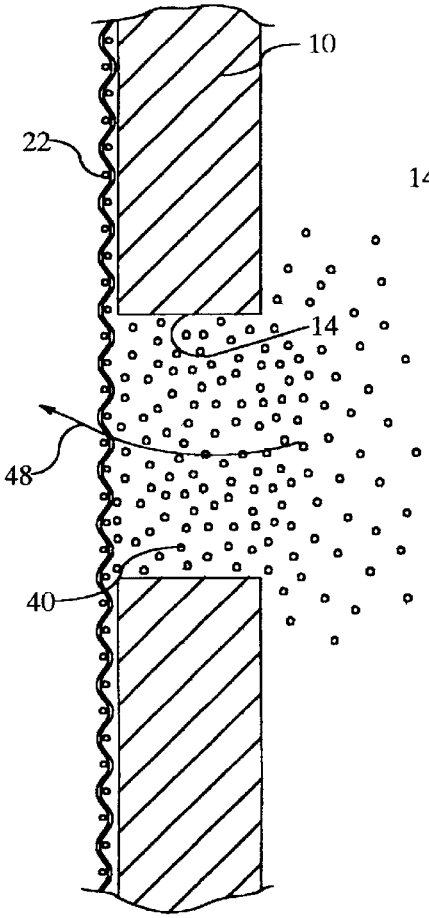
FIG. 3 is an exploded sectional view illustrating the screen in the expanded position adjacent to the casing wall.
Figure 2:
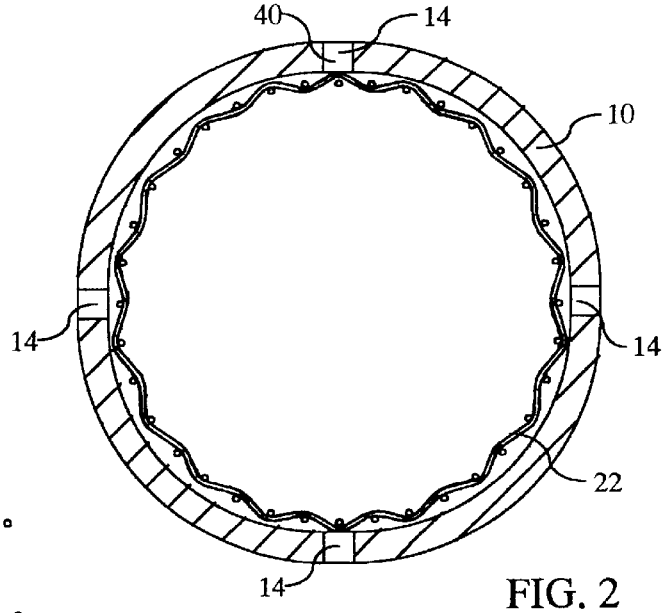
FIG. 2 is an axial sectional view taken on line 2—2 of FIG. 1D looking in the direction of the arrows.

FIGS. 2 and 3 illustrate cross section views of screens in the expanded condition installed according to the method of the present invention. In FIGS. 2 and 3 the screen 22 is shown expanded to span the perforations 14 and act as a proppant flowback control. In this embodiment the proppant 40 has been cleaned from the casing 10. During hydrocarbon production, proppant 40 may migrate as shown into the perforations themselves but the screen will prevent proppant 40 from flowing back into the casing 10 with hydrocarbon production 48.

Figure 4:
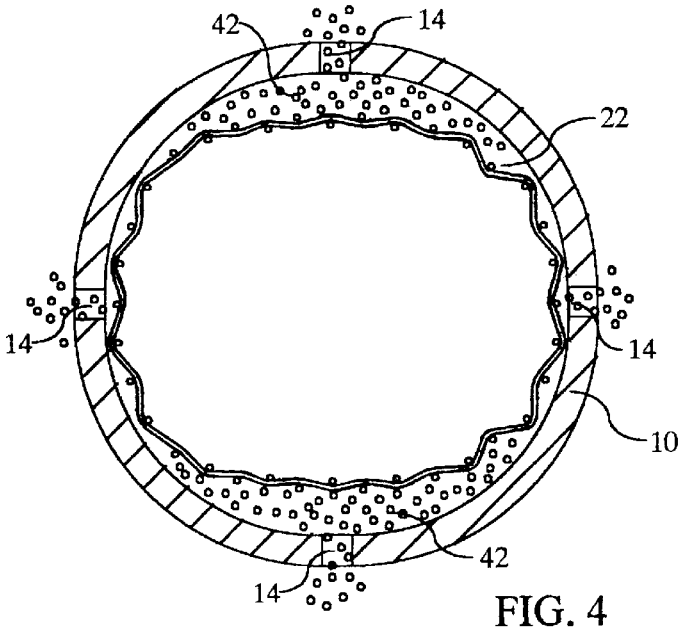
FIG. 4 is an axial sectional views similar to FIG. 2 illustrating another embodiment.

FIG. 4 illustrates the results of expanding the screen 22 where proppant 42 is left in the casing 10. The proppant 42 in the casing will be trapped against the inside wall of the casing increasing proppant screen contact area.

By completing a well according to the methods and apparatus of the present inventions a long-term proppant flowback control can be achieved, regardless of reservoir conditions, such as high temperature, high production flow rate. Problems with chemical compatibility, as faced by chemical flowback control means is avoided. No chemical or environmental issues are present with this mechanical means as stricter environmental regulations are required. No physical restriction within the wellbore occurs in that existing thru-tubing, inflatable based isolation systems become feasible, allowing well intervention options as necessary. In addition, slimmer well designs are allowed while still providing maximum through bore passage.

The screen design and method in the embodiments shown and described above are only exemplary. Many details are found in the art relating to hydraulic fracturing, expandable screens, packers, bridge plugs, casing patches or the like. To describe the present invention the screen is shown in a single zone completion. Therefore, many such details are neither shown nor described. It is not claimed that all of the detail parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed is:

1. An improved method of treating a subterranean hydrocarbon bearing formation penetrated by a perforated section of a cased wellbore comprising the steps of:

pumping through the cased wellbore and the perforations and into the formation a treating mixture at a pressure sufficient to create fractures in the formation, the treating mixture comprising a particulate material suspended in a fluid and depositing the mixture in the fractures in the formation;

selecting a circumferentially expandable mesh screen of a size to pass through the casing when unexpanded and to engage the inside of the perforated casing section when expanded and with an expanded mesh size sufficient to block the flow of the particulate material there through;

moving the screen through the casing and positioning the screen in the perforated section of the casing;

circumferentially expanding the screen against the inside of the casing wall and across the perforations; and flowing hydrocarbons from the formation through the expanded screen while the screen prevents the particulate material from flowing into the well.

2. The method of claim 1 additionally comprising the step of allowing the well to flow back at maximum flow rate after expanding the screen to remove treating fluid and to pack particulate in the perforations and position particulate against the outer surface of the screen.

3. The method of claim 1 wherein the pumping step comprises hydraulic fracturing including using a particulate that has been selected to generate propped fractures.

4. The method of claim 1 additionally comprising the step of inserting tubing in the well after the pumping step and circulating particulate from inside the casing to the surface.

5. The method of claim 1 additionally comprising the step of using coated particulate.

6. The method of claim 1 additionally comprising the step of discontinuing pumping to allow the fractures to retain the particulate material in the formation.

7. An improved method of removing and separating hydrocarbons from a subterranean hydrocarbon bearing formation penetrated by a perforated section of a cased wellbore where in the hydrocarbons are mixed with formation materials, comprising the steps of:

pumping at a pressure sufficient to create fractures in the formation, through the cased wellbore, the perforations and into the formation a treating mixture comprising a particulate material suspended in a fluid and depositing the mixture in fractures in the formation;

selecting a circumferentially expandable mesh screen of a size to pass through the casing when unexpanded and to engage the inside of the perforated casing section when expanded and with an expanded mesh size sufficient to prevent the flow of the particulate material there through;

moving the screen through the casing and positioning the screen in the perforated section of the casing;

circumferentially expanding the screen against the inside of the casing wall and across the perforations;

flowing hydrocarbons from the formation into the casing through perforations and the expanded screen while the screen prevents the particulate material from flowing into the well; and removing the hydrocarbons from the well.

8. The method of claim 7 additionally comprising the step of allowing the well to flow back at maximum flow rate after expanding the screen to remove treating fluid and to pack particulate in the perforations and position particulate against the outer surface of the screen.

9. The method of claim 7 wherein the pumping step comprises hydraulic fracturing including using a particulate that has been select to generate propped fractures.

10. The method of claim 7 additionally comprising the step of inserting tubing in the well after the pumping step and circulating particulate from inside the casing to the surface.

11. The method of claim 7 additionally comprising the step of using of coated particulate.

12. The method of claim 7 additionally comprising the step of discontinuing pumping to allow the fractures to retain the particulate material in the formation.

* * * * *

UNITED STATES PATENT AND TRADEMARK OFFICE

CERTIFICATE OF CORRECTION

PATENT NO. : 6,659,179 B2
DATED : December 9, 2003
INVENTOR(S) : Philip D. Nguyen It is certified that error appears in the above-identified patent and that said Letters Patent is hereby corrected as shown below:

Title page,
Item [73], Assignee, should read:
-- Halliburton Energy Services, Inc.
Houston, TX (US) --

Signed and Sealed this

Eighteenth Day of January, 2005

JON W. DUDAS
*Director of the United States Patent and Trademark Office*